US007661364B2

(12) United States Patent
Zinell et al.

(10) Patent No.: US 7,661,364 B2
(45) Date of Patent: Feb. 16, 2010

(54) SAFETY AND ARMING UNIT FOR A SPINNING PROJECTILE FUZE

(75) Inventors: Alexander Zinell, Aichhalden (DE); Reiner Hennig, Mönchweiler (DE); Alfred Boos, Tennenbronn (DE)

(73) Assignee: Junghans Microtec GmbH, Dunningen-Seedorf (DE)

( * ) Notice: Subject to any disclaimer, the term of this patent is extended or adjusted under 35 U.S.C. 154(b) by 129 days.

(21) Appl. No.: 11/858,770

(22) Filed: Sep. 20, 2007

(65) Prior Publication Data

US 2008/0210117 A1 Sep. 4, 2008

(30) Foreign Application Priority Data

Oct. 7, 2006 (DE) ..... 10 2006 047 551

(51) Int. Cl.
*F42C 15/22* (2006.01)

(52) U.S. Cl. ..... 102/237; 102/222; 102/245; 102/254; 102/256; 102/262

(58) Field of Classification Search ..... 102/222, 102/237, 244, 245, 254, 256, 262
See application file for complete search history.

(56) References Cited

U.S. PATENT DOCUMENTS 2,903,534 A 5/1959 Bleakney et al.
3,381,613 A * 5/1968 Webb ..... 102/207
3,486,452 A 12/1969 Glowacki
3,603,259 A 9/1971 Webb
3,780,660 A * 12/1973 Webb et al. ..... 102/245
4,034,674 A 7/1977 Abt
4,457,232 A 7/1984 Post

FOREIGN PATENT DOCUMENTS

DE 41 19 337 A1 6/1991
EP 0 476 735 A1 3/1992
GB 1 463 112 2/1977

* cited by examiner

*Primary Examiner*—James S Bergin
*Assistant Examiner*—Daniel J Troy
(74) *Attorney, Agent, or Firm*—Scully, Scott, Murphy & Presser, P.C.

(57) ABSTRACT

A safety and arming unit (11) which is designed in particular for an electrical fuze circuit (27) does not reliably respond just to lateral loads on one side, but responds only to centrifugal forces produced by the spin during free flight, in that two contact pairs (22-23, 22-23) which are connected electrically in parallel with one another via rings (14, 15) and are arranged diametrically opposite one another on a cross-sectional plane of the fuze (12) are both no longer electrically conductively bridged at the same time by the bolt (17) because, just by virtue of the centrifugal force, both bolts (17) are simultaneously moved radially outwards from their short-circuit safety positions in their blind holes (16), which are oriented transversely with respect to the rotation axis (13).

9 Claims, 3 Drawing Sheets

SAFETY AND ARMING UNIT FOR A SPINNING PROJECTILE FUZE

BACKGROUND OF THE INVENTION

1. Field of the Invention

The invention relates to a safety and arming unit for a spinning projectile fuze, which includes a spring loaded bolt that is capable of being moved as a function of centrifugal force.

2. Discussion of the Prior Art

A safety and arming unit such as this is known from DE 41 19 337 A1 in order to ensure, in addition, a second arming criterion, which is dependent on the spin in free flight after the projectile has been launched. This safety device has a bolt which is installed parallel to the longitudinal and rotation axis of the spinning projectile, to which a fuze is fitted coaxially. By virtue of its installation characteristics, the bolt cannot only be moved axially against a restoring spring force by virtue of the firing acceleration, but can also be moved at an angle to the bolt axis by virtue of the centrifugal force of the projectile spin. If the centrifugal force does not occur to an adequate extent after the firing acceleration has decayed, the bolt is not pivoted as far as an armed locked position, but is moved back to its orientation parallel to the axis, over ramps, under the influence of the spring, and is moved back to the safe position, in which it once again blocks a previously mechanically released arming rotor. This results in the projectile becoming a live misfire, which, however, should be avoided, because of the possibility of collateral damage. A further disadvantage is that a safety bolt which can be moved and pivoted in this way is in any case difficult to integrate in a modern in-line faze device with secondary explosive which can be initiated electrically, for example via an EFI detonator.

Against the background of these circumstances, the invention is based on the technical problem of designing a safety and arming unit of this generic type for an electrical in-line firing circuit and at the same time opening up as far as possible functional optimization such that lateral accelerations which occur only temporarily do not in their own right lead to blocking of an arming process which occurs only after this as a function of the spin.

SUMMARY OF THE INVENTION

According to the invention, this object is achieved by the features in that at least one bolt is oriented transversely with respect to the fuze axis, electrically conductively (resistively) bridging two contacts located in an electrical circuit This short-circuit bolt is moved axially against a restoring spring after launch, under the influence of the spin-dependent centrifugal force (to be precise to its armed position) sufficiently that the contact bridging is finally cancelled, that is to say the safety circuit is opened. Lateral accelerations which occur only briefly, in contrast, do not in their own right lead to sufficient movement for permanent enabling, but the spring-loaded bolt is at the same time moved back to its safe position, in which it still remains operable, with the electrical short-circuit across its contact pair still being present, albeit restored.

This safety and arming unit therefore represents a sensor, which responds to the interruption of a circuit as the arming criterion, and to this extent can be included without any problems as circuitry in the logical links for the firing circuit. The decay of lateral accelerations which occur only briefly results in the spring load returning the bolt to its safe position, with the electrically conductive bridging of the contact pair being maintained or restored; until a longer-lasting spin-dependent centrifugal force leads to the bolt finally being moved out of its short-circuited position and, with the current finally being interrupted, to sensor response to the arming criterion having occurred.

In consequence, this safety and arming unit is, for example, insensitive to lateral accelerations which occur temporarily from lateral positions during drop tests, and is also insensitive to the lateral forces which are enormous but occur only briefly during the use of an automatic loader, thus, for this purpose, even guaranteeing the so-called flick-ramming safety.

In order to ensure that the bolt cannot be moved too quickly from its short-circuited position to the open armed position located radially on the outside; a physical constraint is expedient, acting as a mechanical low-pass filter. This can be provided from the production engineering point of view relatively simply and therefore cost-effectively and functionally reliably by providing a helical guide for the linear bolt movement, for example in the form of a groove in a hollow-cylindrical inner wall, in which a radially projecting tab from the bolt engages.

Since, by virtue of-its design, the bolt can move further only outwards, that is to say radially from the faze axis, a further improvement in functional reliability is obtained by arranging (at least) two such bolt contact pairs physically diametrically opposite one another, and connecting them electrically in parallel. This is because a shock load acting on only one side, for example in test conditions or during handling, then in any case results in only one of the two bolts being moved (temporarily) outwards; the opposite bolt remains in its rest position against a physical stop and ensures that the other, parallel-connected contact pair remains bridged in a stationary form, thus still reliably preventing arming and enabling of the firing circuit. Only when both of the bolts are simultaneously moved radially outwards, by centrifugal force, to such an extent that their contact pairs, which are connected electrically in parallel with one another, are both opened is the circuit via the contact pairs actually interrupted, thus satisfying the electrical arming criterion.

In order to avoid wiring systems which are complex to manufacture and are functionally critical because of the extraordinarily high acceleration forces which occur when the munition is being launched, conductors which are at least in the form of half rings and are axially offset with respect to one another, and insulated and which each have a radial blind hole, which intersects both rings and is open away from the fuze axis for accommodating a bolt are advantageously provided for the sensor or safety circuit. This is expediently in the form of a through-hole, which, however, is then closed towards the faze axis by a local cover or a circumferential ring. A cutout to hold the bolt which is being moved out of its contact position is formed opposite in the installation environment, that is to say for example directly in the fuze wall. The compression spring, for example a helical spring, is also mounted at its opposite end here, if the resetting spring force is not exerted for example by a radially elastic ring which is peripherally circumferential over all the bolt positions, like a rubber band. The cavity which is introduced into the fuze inner wall should expediently be designed to be sufficiently deep transversely with respect to the spin axis that the associated bolt can also slide entirely out of its blind hole, as a result of the centrifugal force, against the spring pressure, and is entirely held there, because it cannot be moved back again into the blind hole by the spring from this position, owing to the lack of longitudinal guidance outside the blind hold.

BRIEF DESCRIPTION OF THE DRAWINGS

Additional developments and alternatives of and to the solution according to the invention will become evident from the following claims and also, with regard to their advantages, from the following description of one preferred implementation example, the drawing of which is restricted to what is essential to its operation and is not sketched entirely to scale. In the drawing:

DETAILED DESCRIPTION OF THE INVENTION

Figure 1:
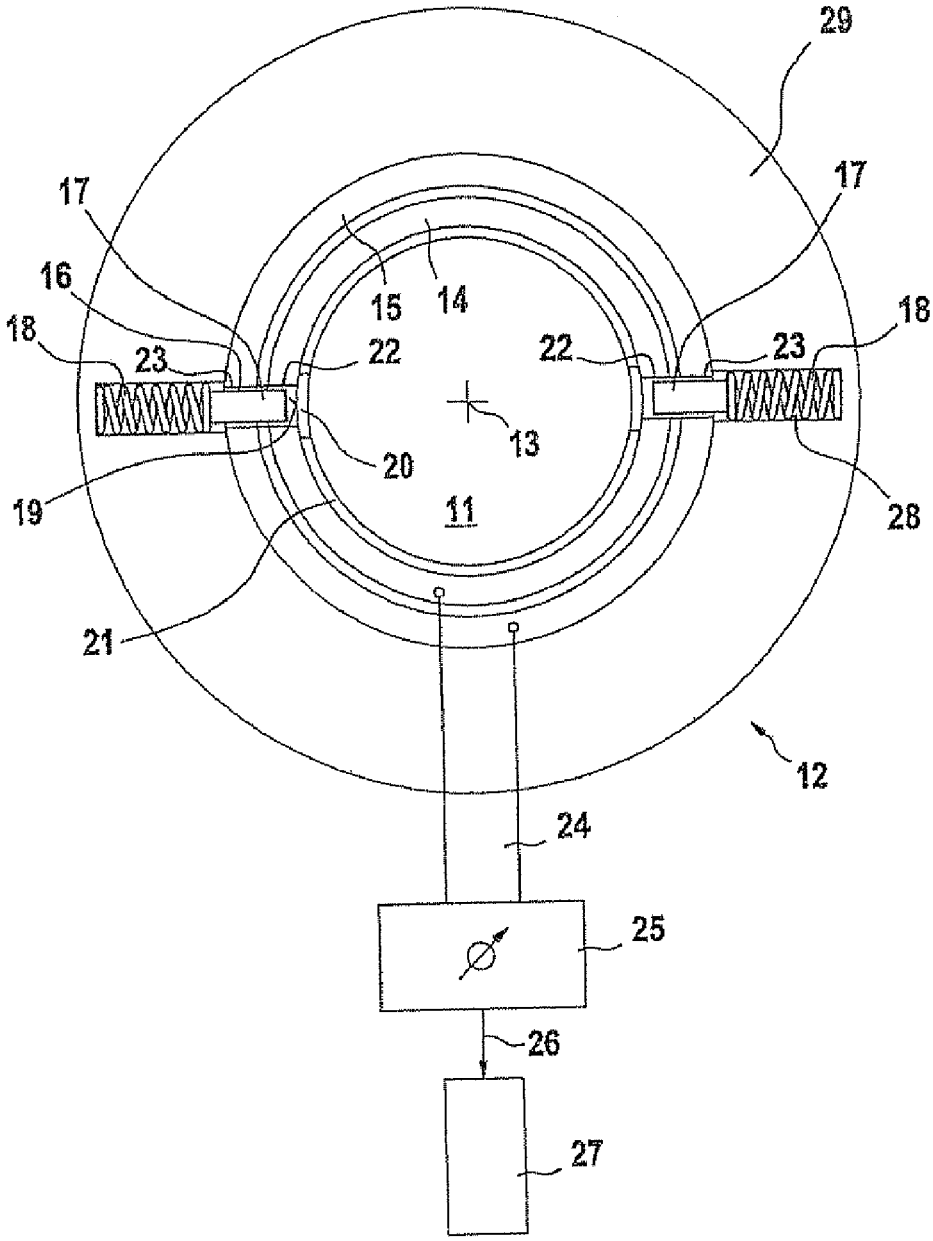
FIG. 1 shows an axial cross section through a fuze ogive illustrating the stationary positions of two short-circuit bolts, which are arranged diametrically opposite one another, in their guides, based on the safety and arming unit according to the invention.
Figure 2:
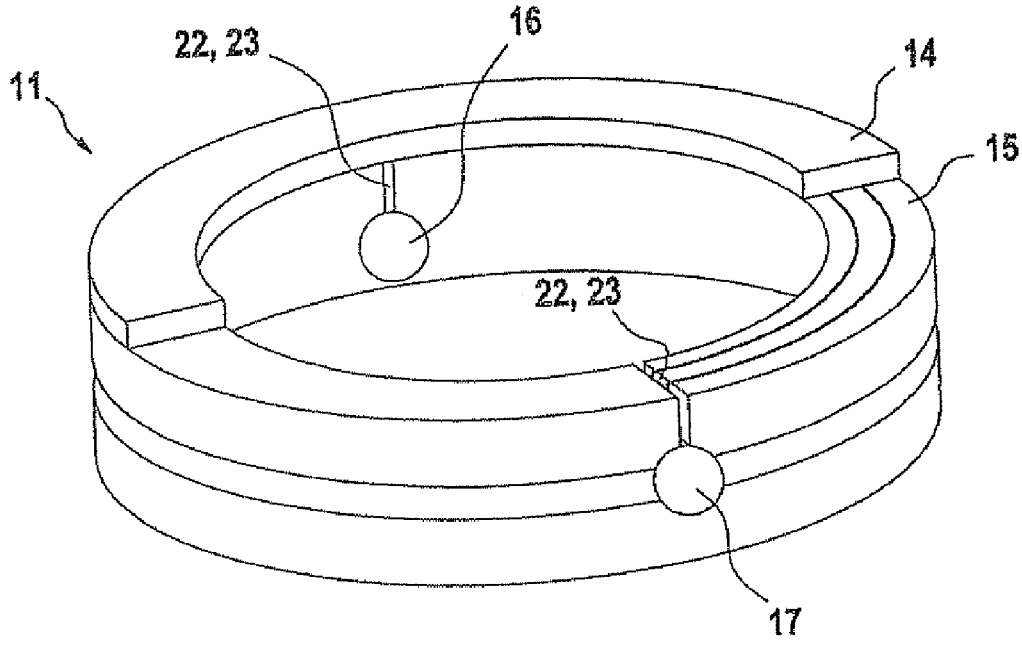
FIG. 2 shows an oblique view of a design for a safety and arming unit such as this itself.
Figure 3:
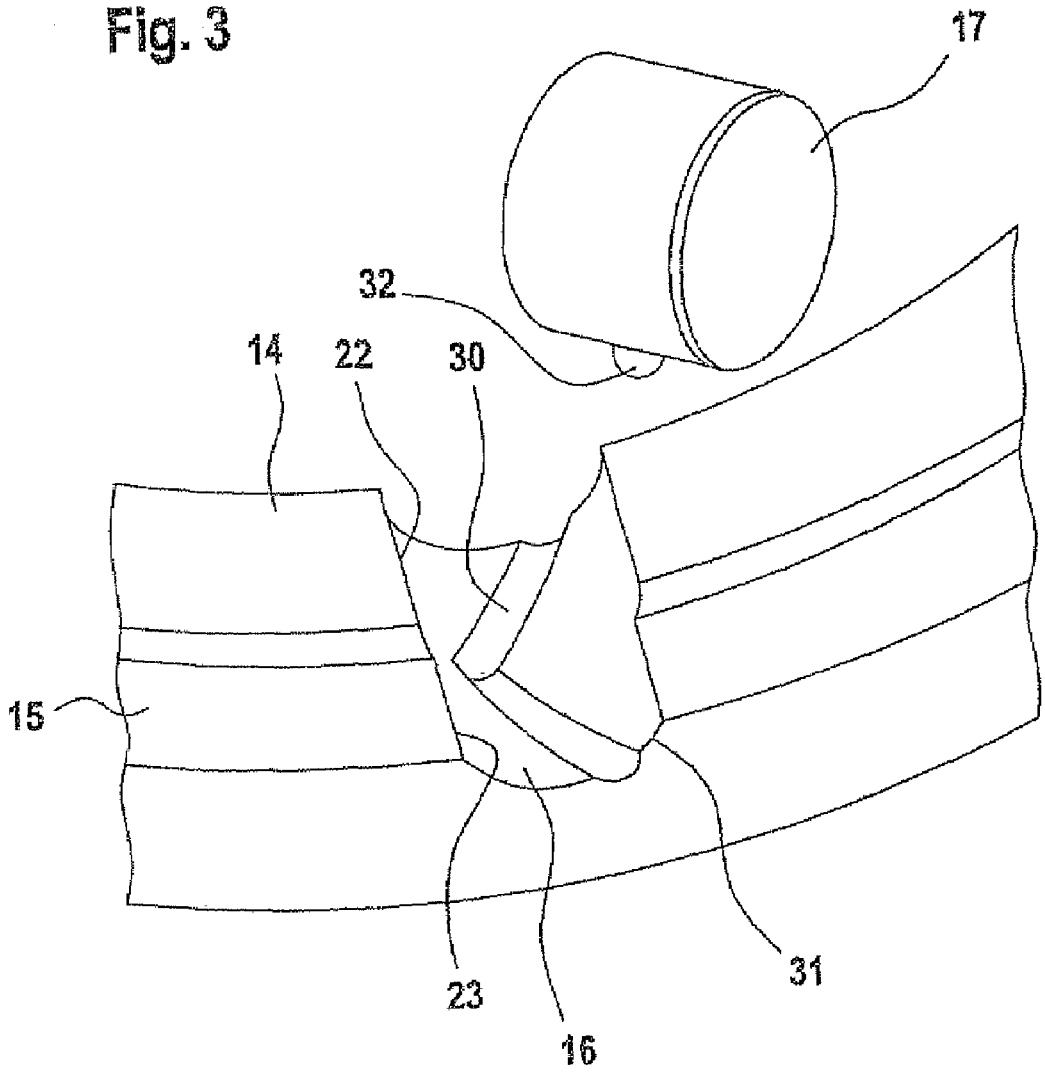
FIG. 3 shows, in the form of a detail, a helical curve guide for slowed-down longitudinal movement of the short-circuit bolt out of its safe position.

The cross-sectional illustration of a safety and arming unit 11 shown in FIG. 1 illustrates its coaxial installation in the conically tapering area of a fuze 12 for a spin-stabilized munition. Two rings 14, 15, which are located concentrically one above the other or, as illustrated, in one another, with respect to the flight and spin axis 13, which is also the longitudinal or system axis 13 of the projectile with its fuze 12, may be composed of plastic and may be electrically conductively coated at least over a semicircle; however, owing to the considerably greater mechanical load capability, these are preferably solid metallic rings 14, 15, which are composed of electrically conductive material such as copper or aluminium and are radially entirely circumferential, as shown in FIG. 1 and FIG. 3, or are formed over a semicircle, as shown in FIG. 2, and are isolated from one another with the interposition of an insulating strip.

A blind hole 16 which points radially with respect to this system axis 13 is used to hold and for hollow cylindrical longitudinal guidance of a bolt 17. The bolt 17 is itself clamped in axially between a centripetally acting spring 18 and the blind-hole base 19. From the manufacturing point of view, it is simpler to introduce a radial hole through the rings 14, 15 and to close this hole by a cover 20, or a band 21, which covers the entire circumference, towards the axis 13. This is because the band 21 would then also close further through-holes to form blind holes 16 for holding bolts 17, as is illustrated in the drawing, for a further, diametrically opposite, position.

In the blind hole 16, the mutually parallel rings 14 and 15, which are isolated from one another per se, both make contact with the bolt 17 at the same time. The bolt 17 may be electrically conductively coated; however, the bolt 17 is preferably composed of solid electrically conductive material. The two rings 14, 15 thus in this case represent a contact pair 22-23, which is resistively bridged, that is to say short-circuited, by the bolt 17 which, in its stationary rest position in the blind hole 16, projects in between them. The two contact pairs 22-23/22-23, which are diametrically opposite one another on a cross-sectional plane, are connected electrically in parallel with one another via the electrically conductive rings 14, 15 over at least half the circumference.

Only if the bolt 17 is oriented appropriately does the influence of an appropriately oriented lateral-force component lead to the bolt 17 moving against the force of the resetting spring 18 from the rest position of the end stop against the blind-hole base 19 (in front of the cover 20) out of the blind hole; the diametrically opposite bolt 17 is accelerated in its hollow-cylindrical longitudinal guide in the same resultant direction, and therefore remains in its safe rest position, supported against the blind-hole base 19.

The short circuit via one of the contact pairs 22-23, for example between the two rings 14-15, is thus maintained in that opposite blind hole 16 provided that only the other bolt 17 has moved radially outwards. Since this therefore results in only one of the two contact pairs 22-23, which are connected in parallel with one another, being open, while the other remains bridged, the safety circuit 24, in which the circuits of the two contact pairs 22-23 are connected in parallel with one another, opens, but not yet. If the force component acting on the other bolt 17 in its longitudinal direction disappears again, this bolt 17 is moved back again by its spring 18 against the blind-hole base 19 to its safe rest position as well, in which its contact pair 22-23 is also still bridged.

If, in contrast, when the munition is in free flight, the centrifugal force created by the spin moves both bolts 17 axially (radially with respect to the spin axis 13) outwards from their rest positions in the respective blind hole 16, both contact pairs 22-23 finally open, and the safety circuit 24 is interrupted. This can be sensed by a test circuit 25, which now supplies a free-flight arming signal 26 to the firing circuit 27.

The centrifugal forces expediently result in the bolts 17 all sliding entirely out of their blind holes 16 and each entirely entering a concentrically adjacent cavity 28, which is incorporated in the inner casing surface of the fuze wall 29 and which supports the resetting spring 18 against its base. Because there is no longitudinal guidance from the blind hole 16 in the cavity 28, the spring 18 cannot push the bolt 17 back again into the blind hole 16 to its contact pair 22-23 once the centrifugal force has decayed. The bolt 16 therefore remains reliably held in its cavity 28, without any disturbance, and the fuze 12 is armed once this criterion has been satisfied once—returning to the safe position is actually mechanically reliably prevented in this way, although this can additionally also be ensured by the monostable switching behaviour of the test circuit 25.

If a lateral acceleration occurs only temporarily, the bolt 17, as already mentioned, should be moved back by the resetting spring 18 to its short-circuit position, that is to say it will not yet have left its blind hole 16. The spring 18, which acts in the opposite direction, results, depending on its spring constant and as a function of movement, in a bolt 17 not moving too quickly out of its blind hole 16 under the influence of a lateral force which acts only temporarily on the system axis 13. This restriction to the bolt movement is expediently amplified, irrespective of the movement, as shown in FIG. 3 by a mechanical guide along a helical curve 30. As illustrated, this is incorporated in the hollow-cylindrical inner casing surface of the blind hole 16. A tab 32, which engages in the helical curve 30 projects radially from the outer casing surface of the bolt 16, in order to guide it. This helical guidance superimposes a rotary movement on the longitudinal movement of the bolt 17, and correspondingly delays the longitudinal movement out of the blind hole 16. If the lateral acceleration does not last too long, the bolt 17 can then be pushed back again by its spring 18 to the short-circuit position in the blind hole 16, so that the safety function remains fully operable until centrifugal forces occur.

A safety and arming unit 11 which is designed in particular for an electrical firing circuit 27 thus reliably does not yet respond to lateral accelerations on just one side, but only to centrifugal forces resulting from the spin during free flight, in that, according to the invention, two contact pairs 22-23, 22-23 which are electrically connected in parallel with one another via annular arcs and are formed diametrically opposite one another are both no longer electrically conductively bridged by the bolts 17, 17 at the same time, because both bolts 17, 17 have been moved radially outwards only by the centrifugal force at the same time in their blind holes 16, 16, which are oriented transversely with respect to the rotation axis 13, from their short-circuit safe positions.

LIST OF REFERENCE SYMBOLS

11 Safety and arming unit
12 Fuze (with 11)
13 Axis (with 11, 12; 14, 15)
14 Ring
15 Ring
16 Blind hole (through 14, 15)
17 Bolt (in 16 over 22-23)
18 Spring (between 17 and 28)
19 Base (of 16)
20 Cover (behind 16)
21 Band (forming 20)
22 Contact (on 14)
23 Contact (on 15)
24 Safety circuit (across 22-23)
25 Test circuit (in 24)
26 Arming signal (from 25 for 27)
27 Firing circuit (in 12)
28 Cavity (in 29)
29 Wall (of 12)
30 Helical curve (in 31)
31 Inner casing surface (of 16)
32 Tab (on 17, in 30)

What is claimed is:

1. A safety and arming unit (11) for a spinning projectile fuze (12), at least two pairs of resistive contacts (22-23) are provided offset peripherally with respect to one another about the circumference of the fuze (12) and connected electrically in parallel with one another, at least two spring-loaded bolts (17) which are spaced about the circumference of said fuze and are movable as a function of centrifugal force, each said bolt (17) having respectively one of the pairs of said resistive contacts (22-23) operatively associated therewith, and wherein each of the bolts (17) is movable against the force of a return spring (18) transversely with respect to the rotational and longitudinal axis (13) of the fuze (12) from an electrical short-circuit position past two of said resistive contacts(22-23) which are connected in series with a safety circuit (24), such that an electrically conductive bridging of each respective pair of resistive contacts (22-23) by the herewith associated bolt (17) is interruptible responsive to the occurrence of the centrifugal force.

2. A safety and arming unit according to claim 1, wherein the resistive contact pairs (22-23) are arranged on electrically conductive arcs which are concentrically adjacent at a distance from one another radially, axially or cireumferentially.

3. A safety and arming unit according to claim 1, wherein said two pairs of said resistive contacts (22-23) located mutually diametrically opposite one another.

4. A safety and arming unit according to claim 3, wherein the contact pairs (22-23) are arranged selectively on two semi-circumferential or full-circumferential rings (14, 15) each consisting of an electrically conductive material.

5. A safety and arming unit according to claim 1, wherein each respective said bolt (17) that electrically bridges a therewith associated resistive contact pair (22-23) is guided longitudinally in a blind hole (16) that is oriented radially with respect to the longitudinal fuze axis (13).

6. A safety and arming unit according to claim 5, wherein each said blind hole (16) possesses the form of a through-hole, a base (19) of which is closed towards the longitudinal fuize axis (13) by selectively a cover (20) or band (21).

7. A safety and arming unit according to claim 6, wherein a cavity (29) for holding the respective bolt (17) which projects from the blind hole (16) in which it is guided, is formed opposite the base (19) of the blind hole (16) in an inner casing surface (31) of a fuze wall (29).

8. A safety and arming unit according to claim 5, wherein each said bolt (17) is provided with a tab (32) which engages in a helical curve (30) formed in said blind hole (16) arranged in an inner casing surface (31) of a fuze wall (29).

9. A safety and arming unit (11) for a spinning projectile fuze (12), having at least one spring-loaded bolt (17) which is movable as a function of the centrifugal force, wherein the at least one bolt (17) is movable against the force of a return spring (18) transversely with respect to the rotational and longitudinal axis (13) of the fuze (12) from a short-circuit position past a pair of resistive contacts (22-23) which are connected in series with a safety circuit (24), said at least one bolt (17) electrically bridging over said pair of resistive contacts (22-23) being guided longitudinally in a blind hole (16) that is oriented radially with respect to the fuze axis (13), and said at least one bolt (17) being provided with a tab (32) which engages in a helical curve (30) of the blind hole (16) that is arranged in an inner casing surface (31) of a fuze wall.

* * * * *